United States Patent [19]

Judd

[11] Patent Number: 5,050,665

[45] Date of Patent: Sep. 24, 1991

[54] INVESTMENT CAST AIRFOIL CORE/SHELL LOCK AND METHOD OF CASTING

[75] Inventor: James A. Judd, Ellington, Conn.

[73] Assignee: United Technologies Corporation, Hartford, Conn.

[21] Appl. No.: 456,418

[22] Filed: Dec. 26, 1989

[51] Int. Cl.[5] ..... B22C 9/10; B22D 33/04

[52] U.S. Cl. ..... 164/137; 164/30; 164/340; 164/361; 164/370

[58] Field of Search ..... 164/137, 30, 31, 32, 164/340, 361, 365, 369, 370

[56] References Cited

U.S. PATENT DOCUMENTS

| | | | |
|---|---|---|---|
| 4,093,017 | 6/1978 | Miller, Jr. et al. | 164/361 X |
| 4,487,246 | 12/1984 | Frasier | 164/361 X |
| 4,596,281 | 6/1986 | Bishop | 164/370 X |
| 4,627,480 | 12/1986 | Lee | 164/369 |

FOREIGN PATENT DOCUMENTS

| | | | |
|---|---|---|---|
| 3723260 | 1/1988 | Fed. Rep. of Germany | 164/340 |
| 56-109140 | 8/1981 | Japan | 164/340 |
| 1-95859 | 4/1989 | Japan | 164/340 |
| 492339 | 2/1976 | U.S.S.R. | 164/369 |

*Primary Examiner*—Richard K. Seidel
*Assistant Examiner*—J. Reed Batten, Jr.
*Attorney, Agent, or Firm*—Christopher T. Hayes

[57] ABSTRACT

The tapered core/shell lock includes notches which, in conjunction with protrusions from the shell mold, prevent axial slip of the core main body. In addition, the core/shell lock provides a tapered core print area which is much larger, and extends further into the shell mold, then the conventional "T" bar core/shell lock. By increasing the axial length of the core print area, shifting at the tip of the core main body is reduced, while tapering of the core print eliminates the need to lacquer slip the end of the core/shell lock, eliminating addtional sources of core shift.

20 Claims, 2 Drawing Sheets

FIG.1 PRIOR ART
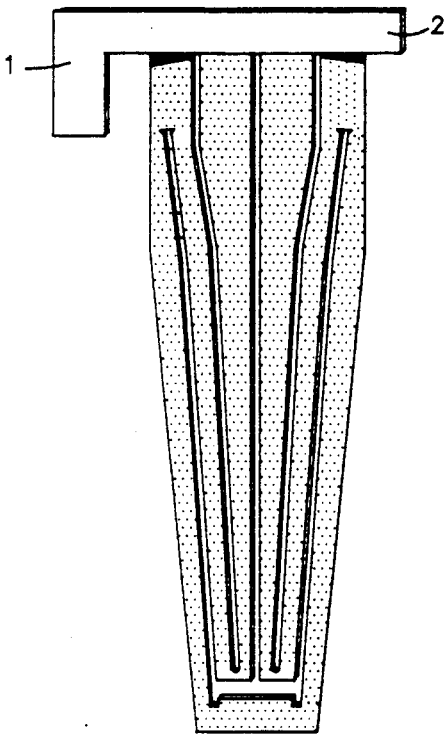
FIG.2
PRIOR ART
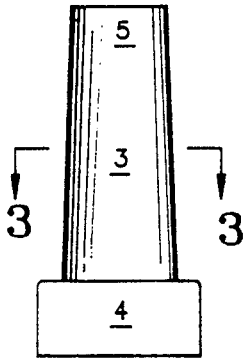
FIG.3
PRIOR ART
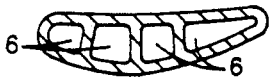
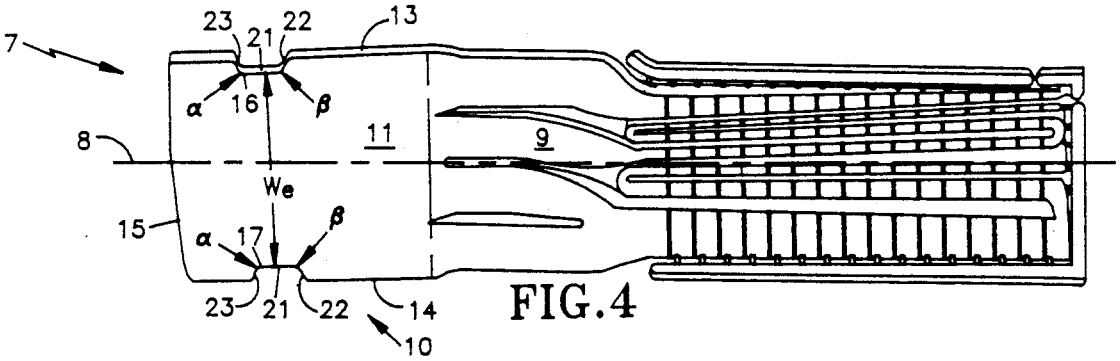
FIG.4
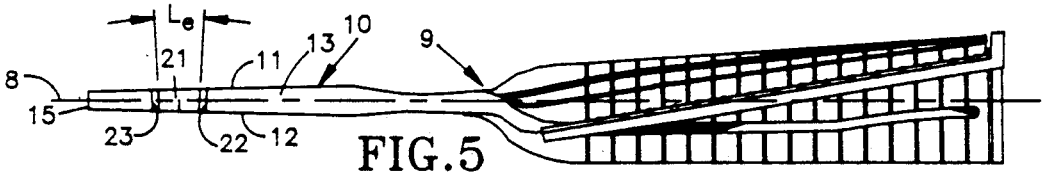
FIG.5

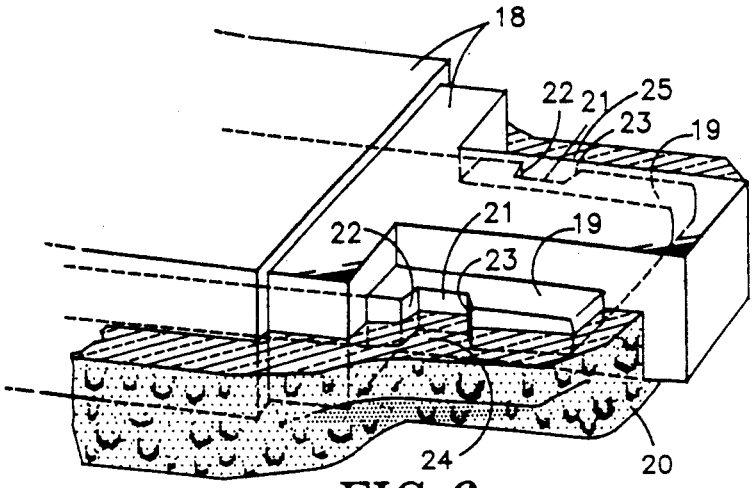
FIG.6
FIG.7
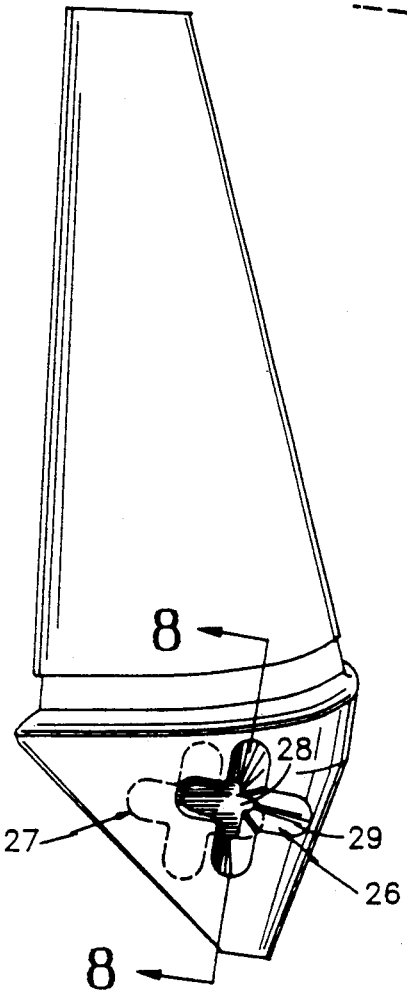
FIG.8
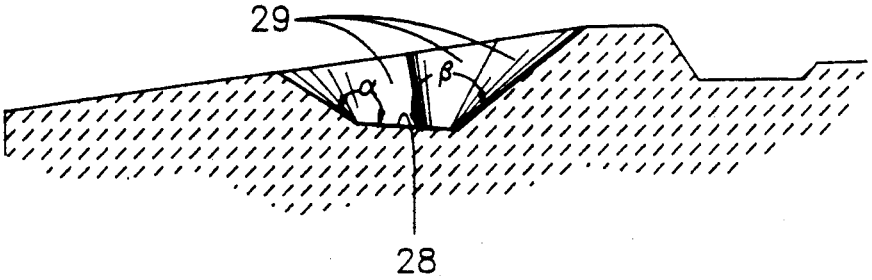

INVESTMENT CAST AIRFOIL CORE/SHELL LOCK AND METHOD OF CASTING

DESCRIPTION

1. Technical Field

This invention relates to the field of precision investment casting molds in which cores are used to form hollow cavities in cast articles, and more specifically relates to a means for controlling the movement or shifting of a core within a shell mold.

2. Background of the Invention

Precision investment casting procedures are frequently used to produce investment mold castings containing hollow cavities. In particular, cast articles such as turbine blades and vanes used in jet engines incorporate hollow cavities which serve as passages for cooling air needed during operation of the engine. In one of the conventional methods of casting a turbine blade or vane, a ceramic core having a core/shell lock and contours identical to the desired cooling air passages is formed in a core mold. The core is then positioned into a wax injection pattern mold by means of core prints so that the core is properly spaced from the pattern mold wall. Melted wax is then injected into the pattern mold, forming a pattern identical to the desired shape of the turbine blade to be cast leaving the core/shell lock area free from any wax coating and fully exposed to satisfy the requirements of the dipping operation. When the wax has cooled, the core and the wax pattern are removed from the pattern mold as one piece and assembled into a mold assembly containing one or more patterns. This assembly is dipped into a slurry containing a ceramic binder. The ceramic forms a stucco shell around the wax and bonds to the exposed surfaces of the core/shell lock. After the shell has cured the mold assembly is dewaxed and fired, removing the wax and leaving the core supported by the shell mold at the core/shell lock. Metal is subsequently poured into the cavity between the core and the shell mold previously filled by the wax. Once the metal has solidified, the ceramic material is removed, leaving a metal turbine blade whereby outer surfaces were formed by the ceramic shell and the interior interior air passages were formed by the core.

One problem encountered in this type of investment casting is that during the firing and preheating of the mold assembly, the thermal expansion of the core and the shell mold differ. Because the shell mold often experiences much greater thermal expansion than the core, the core tends to shift within the shell mold. When molten metal is subsequently poured into the mold assembly, the core shift affects the wall thickness of the resulting turbine blade to the point that the wall thickness tolerances are exceeded.

In the past, attempts have been made to control such shifting of the core by incorporating a "T" bar core/shell lock into one end, generally the upper end, of the core to anchor the core to the shell mold, and by embedding metal pins into the wax patterns to properly space the core from the shell mold. Such a "T" bar is shown in FIG. 1, having a core/shell lock 1 and an anterior end portion 2. Prior to dipping the mold assembly into ceramic material, unwanted wax is removed from the the core/shell lock 1 and the anterior end 2 of the "T" bar. The anterior end is then covered with a thin layer of lacquer to prevent it from bonding to the shell mold during the dipping process. The core/shell lock 1 remains exposed during the dipping process, establishing a single bond between the core and the shell mold at that point. Upon dewaxing and firing of the mold assembly, the anterior end 2 undergoes a somewhat controlled slip within the surrounding shell mold, thereby allowing the shell mold to expand more than the core without fracturing the core, while at the same time maintaining intact the desired bond between the core/shell lock and the shell mold. With the wax removed, the metal pins provide support necessary to resist hydraulic forces caused by the pouring of molten metal into the pre-heated mold assembly. Although the pins may provide adequate support to the core prior to and during preheating, shortly after introduction of the molten metal the pins melt, becoming part of the turbine blade. From that point on the core is rigidly supported at the core/shell lock 1 and somewhat loosely supported at the anterior end 2, and due to the buoyancy of the core with respect to the molten metal, the core has a tendency to shift. Consequently, manufacturers of turbine blades have found that even with the use of the "T" bar and metal pins, a substantial percentage of the resulting turbine blades have wall thicknesses which exceed acceptable tolerances.

SUMMARY OF THE INVENTION

An object of this invention is to provide a core/shell lock system for precision investment casting which provides improved control of the position of the core with respect to the shell mold, thereby avoiding the type of excessive shifting which can occur with the conventional "T" bar core/shell lock during metal solidification.

According to the first embodiment of the present invention, incorporated into an end of the core, preferably the upper end, is a tapered core/shell lock which extends further into the wall of the shell mold, and provides a greater bearing engagement area, or "core print", between the core/shell lock and the shell mold than the conventional "T" bar core/shell lock. This reduces the core length/core print ratio, reducing core shift at the tip of the core furthest from the core/shell lock. A pair of opposed shell lock notches in the core/shell lock prevents shifting of the core due to buoyancy effects by maintaining intimate contact between the shell mold and the sidewalls of each notch while simultaneously allowing the shell mold to slip outward of the notches during preheating. The tapered core print between the core/shell lock and the shell mold eliminates the need to lacquer the anterior end of the core/shell lock, thereby eliminating an additional source of core shift.

A second embodiment of the present invention incorporates a core/shell lock into an end, preferably the lower end, of the core. This core/shell lock includes a core print which tapers toward the bottom of the core, and includes two complex notches characterized by decreasing cross-sectional area with increasing depth. These notches are coaxial, and prevent shifting of the core in the same manner as the notches described in the first embodiment.

The foregoing and other features and advantages of the present invention will become more apparent from the following description and accompanying drawings.

BRIEF DESCRIPTION OF DRAWINGS

FIG. 1 is an enlarged view of a core incorporating the "T" bar of the prior art.

FIG. 2 shows an plan view of a turbine blade.

FIG. 3 is a sectional view of the turbine blade of FIG. 2 through line 3—3 showing the internal air cooling passages.

FIG. 4 is a plan view, at a slight elevation, of the first embodiment of the core/shell lock of the present invention.

FIG. 5 is a side view of the core in FIG. 4.

FIG. 6 is a partial view in elevation of the first embodiment of the core/shell lock of the present invention substantially encased in wax, further encased in the shell mold.

FIG. 7 is a plan view of a second embodiment of the core/shell lock of the present invention.

FIG. 8 is a cross sectional view of a notch taken along line 8—8 of FIG. 7.

BEST MODE FOR CARRYING OUT THE INVENTION

Although the embodiment set forth in detail below relates to the use of investment molds for casting gas turbine blades, it is offered merely for illustration and is not intended to limit the scope of the present invention.

Referring to FIG. 2, a typical turbine blade is shown including an airfoil portion 3, a root portion 4, and a tip portion 5. As FIG. 3 shows, the blade contains hollow cavities which define cooling air passages 6 through the blade. The ceramic core 7 of the present invention used to form such cooling air passages 6 is shown in FIG. 4, with a longitudinal axis 8 defined therethrough. Preferably, the core is formed by molding within permanent molds so as to insure the uniformity and accuracy thereof. The core 7 includes a main body 9 and a slightly tapered tang 10 which forms the core/shell lock of the present invention. The tang 10 extends along the longitudinal axis 8 of the core 7 and includes two pairs of opposed surfaces 11, 12 and 13, 14 which terminate in an end 15. Each pair of opposed surfaces 11, 12 and 13, 14 slopes toward the longitudinal axis 8 in the direction of the end 15 at a slight angle to the longitudinal axis 8. The tang 10 also includes a pair of notches 16, 17 formed into one of the pairs of opposed surfaces 13, 14. The purpose of these notches 16, 17 is discussed in greater detail below.

FIG. 6 is a cross-sectional perspective view showing the component parts of the mold assembly. After the core 7 has been encased in a wax pattern 18 in a manner known in the art, and with the core print area 19 of the core/shell lock exposed, the wax pattern 18 and the core 7, suspended from the core/shell lock, are repeatedly dipped into a slurry containing ceramic material to build up a stucco shell mold 20. The ceramic material adheres to the wax pattern 18 and to the exposed core print area 19 of the core/shell lock. Although the pattern 18 is generally described herein as being a wax pattern, it may also be made of any other suitable material, such as those set forth in U.S. Pat. Nos. 2,756,475 and 3,722,577, which are incorporated herein by reference. The core 7 and the shell mold 20 are made of any of the ceramic materials known in the art to be useful in making cores and shell molds, such as the materials disclosed in U.S. Pat. Nos. 3,008,204; 3,596,703; 3,722,577 and 4,617,977 and the references cited therein, which are incorporated herein by reference.

Reference numeral 20 refers to the shell mold formed by dipping the core 7 and wax pattern 18 into the ceramic stucco slurry. The wax pattern 18 substantially encases the core 7 such that there is actual contact between the core and shell only in the core print area 19 of the core/shell lock 10. It is believed that the shell mold becomes bonded to the core/shell lock in the core print area 19, but that bond may be so weak that, during preheating of the mold assembly, the bond fails due to the greater thermal expansion experienced by the shell mold than the core. As a result of this difference in thermal expansion, the core may tend to loosen from, and shift with respect to, the shell mold. In order to control this shifting and maintain the core in the correct position within the shell mold, the core/shell lock of the present invention incorporates various tapered surfaces 11, 12, 13, 14 designed to maintain intimate contact between the core/shell lock and the shell mold, even though the surfaces of the core/shell lock and the shell mold may slip with respect to one another. In particular, the present invention incorporates two shell lock notches 16, 17. Each notch includes an end wall 21 connected by two side walls 22, 23 to one surface 13, 14 of the tang 10. The included angles $\alpha$, $\beta$ formed by the end wall and each of the side walls, are related in a manner discussed below.

During the dipping process, ceramic material flows into each notch 16, 17 forming a protrusion 24, 25 on the shell mold 20 which nests with the notch as shown in FIG. 6. When the mold assembly is preheated, each protrusion 24, 25 is drawn outward of the shell lock notch 16, 17 due to the thermal expansion of the shell mold being greater than that of the core. This expansion, and the lesser expansion of the core, could tend to cause the protrusions 24, 25 to lose contact with one or both of the side walls 22, 23 of the notch, opening gaps therebetween. However, each notch was designed with specific included angles $\alpha$, $\beta$ such that thermal expansion of the protrusion 24, 25 in the direction parallel to the longitudinal axis 8 of the core causes the protrusion to remain nested against the sidewalls of the notch, even though the end wall 21 of the notch may no longer be in contact with the corresponding surface of the protrusion.

For a ceramic core which is known to have a coefficient of thermal expansion less than or equal to the ceramic which makes up the shell mold, the magnitudes of the included angles $\alpha$, $\beta$ must be such that:

$$\text{Tan}\,(\alpha-90°)+\text{Tan}\,(\beta-90°)=2(L_e/W_e)$$

where $L_e$ = the length of the end wall in the longitudinal direction $W_e$ = the width of the core/shell lock measured between the end walls The exactness with which $L_e$ and $W_e$ must be measured for use in the aforementioned equation, and the allowable deviation of the values of the included angles $\alpha$, $\beta$ from those values indicated by the equation will, of course, vary depending upon considerations including, but not necessarily limited to, the length of the core, the allowable tolerance of the turbine blade wall thickness, and the strength of the core and shell materials used. If the magnitudes of the included angles $\alpha$, $\beta$ chosen are less than the values indicated by the aforementioned equation, thermal expansion of the protrusion in the longitudinal direction may exceed the amount necessary to merely compensate for the gapping which otherwise occurs due to the protrusion being drawn outward of the notch. The resulting force exerted by the protrusion on the shell lock notch may then cause either the core or the shell mold to fracture. Conversely, if the included angles $\alpha$, $\beta$ chosen exceed the values indicated by the aforementioned equation, thermal expansion of the protrusion in the longitudinal direction may be insufficient to compensate for the gapping which occurs due to the protrusion being drawn outward of the notch. Consequently, during casting the buoyancy of the core with respect to the molten metal may cause the core to shift to the extent permitted by the gapping, which may then result in a turbine blade wall thickness which is beyond allowable tolerances.

During thermal expansion of the core and shell mold, the core print area 19 of the core/shell lock is subjected to the shearing force of the more rapidly expanding shell mold. The slight taper of the pairs of opposed surfaces 11, 12 and 13, 14 allows the shell mold to gradually slip along these surfaces. Consequently, the likelihood that the shear forces will build up to a level which could cause fracturing of the shell mold is reduced.

Although the first embodiment of the core/shell lock 10 incorporates two notches 16, 17 in a flat tang, it will be apparent to those skilled in the art that core/shell locks of any configuration could be used so long as the configuration allows the contacting portion of the shell mold protrusion to slideably expand out of the core/-shell lock while maintaining contact with enough of the core/shell lock to prevent excessive shifting of the core. For example, a second embodiment of the core/shell lock is shown in FIG. 7. This core/shell lock includes two notches 26, 27, on opposite sides of the core/shell lock, which resemble the imprint of a blunt-tipped "Phillips head" screwdriver. The position and orientation of the notches to each other is such that they oppose each other and are coaxial to the extent that if one of the notches had been made by the imprint of a Phillips head screwdriver, and a similar screwdriver were used to make the second notch, the shafts of the two screwdrivers would lie on the same axis. During thermal expansion of the shell mold, each of the shell mold protrusions which nests within these notches 26, 27 moves outwardly along this same axis. A cross section of one notch 26 is shown in FIG. 8, in which the notch 26 has an end wall 28 and a complex sidewall 29 variously angled to accommodate expansion of the shell protrusion as it slides outward of the notch due to thermal expansion. The angles $\alpha$, $\beta$ that the continuous sidewall 29 makes with the end wall 28 are such that any two opposed surfaces of the continuous sidewall 29 must satisfy the aforementioned equation. The opposing notch 27 is similar in construction, and must likewise satisfy the aforementioned equation for the angles $\alpha$, $\beta$.

This second embodiment also differs from the first embodiment in another respect. In the first embodiment the core/shell lock is suspended within the shell mold such that the core main body 9 is vertically below the core/shell lock 7. As a result, during casting the buoyancy of the core with respect to the molten metal will exacerbate even a slight shift of the core, should one occur. In the second embodiment, the core/shell lock remains vertically below the core main body throughout the casting process, and the notches of the second embodiment are positioned so that the given axis on which they are aligned lies vertically below the core's center of buoyancy. By so positioning the notches, the buoyant core main body is anchored to the shell, and during casting the buoyancy of the core tends to counteract even slight shifting of the core, should such occur.

Although only two embodiments of the shell lock notch have been discussed in this disclosure, it will be apparent to those skilled in the art that for a notch of any particular configuration, the angle between the end wall and the sidewall at any given point along the sidewall must meet two criteria. First, as thermal expansion of the shell causes the protrusion to withdraw from the notch along any given axis, the sidewall of the protrusion must remain slideably nested against the sidewall of the notch. Second, the orientation of the notch with respect to the protrusion must remain constant despite thermal expansion of the mold assembly, the only movement being the relative movement of the notch and protrusion along the given axis. Furthermore, though the first and second embodiments of the present invention are described as including the core/shell lock notches near the upper and lower ends, respectively, of the core, those skilled in the art will recognize that the notches could be located at either end of the core.

Although this invention has been shown and described with respect to detailed embodiments thereof, it will be understood by those skilled in the art that various changes in form and detail thereof may be made without departing from the spirit and scope of the claimed invention.

I claim:

1. An investment casting mold having a core and a shell mold, said core including a core main body having a longitudinal axis and a core/shell lock for supporting the core within the shell mold in order to form a cavity within a cast metal article, wherein said core and said shell mold are subjected to heating prior to casting said metal article, and during such heating said shell mold undergoes greater thermal expansion than said core thereby tending to cause said shell mold to loosen from said core, said core/shell lock comprising:

a tapered elongate member extending from said core main body along said longitudinal axis, said elongate member including a first surface that slopes toward said longitudinal axis, and positioning means for controlling shifting of said core with respect to the shell mold, said means for controlling shifting including a first notch in said first surface which cooperates with a first protrusion on said shell mold.

2. The core/shell lock of claim 1 wherein said first protrusion nests within said first notch.

3. The core/shell lock of claim 2 wherein said means for controlling shifting further comprises a second notch in said first surface and a second protrusion on said shell mold, said second protrusion nesting within said second notch.

4. The core/shell lock of claim 3 wherein said first notch and said second notch each include a notch end wall connected to an inner side wall with an angle formed therebetween, each of said inner sidewalls is connected to said first surface, said first protrusion and said second protrusion each includes a protrusion end wall connected to an outer side wall, and prior to thermal expansion of the shell mold, all of the outer side wall of each protrusion is in contact with either said inner side wall of said first notch or said inner side wall of said second notch.

5. The core/shell lock of claim 4 wherein said angle is such that all of the outer side wall of each protrusion which remains within one of said first notch or said second notch during thermal expansion of said shell mold remains in contact with either said inner side wall of said first notch or said inner side wall of said second notch.

6. The core/shell lock of claim 2 wherein said first surface is one surface of a plurality of pairs of opposed surfaces included in said elongate member, the opposing surface of said first surface includes a second notch, and said shell mold includes a second protrusion which nests within said second notch.

7. The core/shell lock of claim 6 wherein each surface of said plurality of pairs of opposed surfaces slopes toward said longitudinal axis.

8. The core/shell lock of claim 7 wherein said first notch and said second notch each includes:

an end wall connected to a first inner side wall, said end wall and said first inner side wall forming an angle therebetween, and each of said first inner side walls is connected to either said first surface or said opposing surface.

9. The core/shell lock of claim 8 wherein said first protrusion and said second protrusion each includes a protrusion end wall connected to an outer side wall, and prior to thermal expansion of the shell mold, all of the outer side wall of each protrusion is in contact with either said first inner side wall of said first notch or said first inner side wall of said second notch.

10. The core/shell lock of claim 9 wherein each of said angles is such that all of said outer side wall of each protrusion which remains within either said first notch or said second notch during thermal expansion of said shell mold, remains in contact with either said first inner side wall of said first notch or said first inner side wall of said second notch.

11. The core/shell lock of claim 7 wherein said first protrusion and said second protrusion each includes a plurality of outer side walls, said first notch and said second notch each includes an end wall connected by a plurality of inner side walls to either said first surface or said opposing surface, and each of said plurality of inner side walls is angled with respect to said end wall such that prior to and during thermal expansion of said shell mold each of said outer side walls lies flat against one of said inner side walls.

12. A core including a main body and a core/shell lock, said main body having a longitudinal axis and said core/shell lock comprising:

a tang extending from said main body along said longitudinal axis, said tang including a first surface which slopes toward said longitudinal axis, said first surface including a first notch.

13. The core/shell lock of claim 12 wherein said first surface is one of a plurality of surfaces of said tang, each surface of said plurality of surfaces is opposed by another of said plurality of surfaces forming pairs of opposed surfaces, said tang including a plurality of such pairs of opposed surfaces, and each of said surfaces slopes toward said longitudinal axis.

14. The core/shell lock of claim 13 wherein said surface which opposes said first surface includes a second notch.

15. The core/shell lock of claim 14 wherein said first notch and said second notch each includes an end wall connected to a first inner side wall forming an angle therebetween, and each of said first inner side walls is connected to either said first surface or said surface which opposes said first surface.

16. The core/shell lock of claim 15 wherein said first notch and said second notch each includes a second inner side wall connected to said end wall, in each of said notches said end wall and said second inner side wall forming a second included angle, said second included angle being obtuse.

17. The core/shell lock of claim 12 wherein said tang is tapered and wherein said first surface includes a second notch opposite said first notch.

18. The core/shell lock of claim 17 wherein said first notch and said second notch each includes an end wall connected by at least one inner side wall to said first surface, said end wall and said at least one inner side wall forms a series of included angles at each point said inner side wall meets said end wall, and each of said included angles is obtuse.

19. In making a cast metal article having a hollow cavity and a wall of variable thickness, wherein a core is supported within a shell mold by a core/shell lock having a plurality of surfaces which extend into a wall of the shell mold and terminate in an end such that the core is spaced from the mold and contacts the mold only at the core/shell lock, and the core, due to differing thermal expansion of the core and the shell mold during preheat and casting processes, is subject to excessive shifting within said shell mold which may result in the cast article having a wall thickness which is beyond desired tolerances, the improvement which comprises a method of reducing shift of the core and thereby maintaining the wall thickness within desired tolerances, including:

extending the end of the core/shell lock a distance into the wall of the shell mold that is sufficient to resist those hydraulic and buoyancy forces on the core caused by introduction of molten metal into the shell mold, compensating for the differing thermal expansion between the core and the shell mold by allowing the shell mold to slip with respect to the surfaces of the core/shell lock by tapering said surfaces which bear upon said shell mold, maintaining the position of the core within the shell mold during the preheat and casting processes by providing the core with notch means which cooperate with protrusion means on said shell mold to maintain the relative positions of the core and shell mold despite thermal expansion, so that any force which acts to shift the core during the casting process produces no shift greater than that which results in a wall thickness within desired tolerances.

20. The method of claim 19 wherein the core is positioned above said notch means, so that the buoyancy of said core tends to prevent excessive shifting of said core.

* * * * *